US007234472B2

(12) United States Patent
Ramet

(10) Patent No.: US 7,234,472 B2
(45) Date of Patent: Jun. 26, 2007

(54) COMB CAPABLE OF BEING USED TO SEPARATE LOCKS OF HAIR

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 8 days.

(21) Appl. No.: 10/875,247

(22) Filed: Jun. 25, 2004

(65) Prior Publication Data

US 2005/0028834 A1 Feb. 10, 2005

Related U.S. Application Data

(60) Provisional application No. 60/488,402, filed on Jul. 21, 2003.

(30) Foreign Application Priority Data

Jun. 30, 2003 (FR) ..... 03 07921

(51) Int. Cl.
*A45D 24/00* (2006.01)

(52) U.S. Cl. ..... 132/139; 132/161; 132/270

(58) Field of Classification Search ..... 132/139, 132/161, 140, 270, 208, 116, 126, 138; D28/21, D28/25, 28–31, 34
See application file for complete search history.

(56) References Cited

U.S. PATENT DOCUMENTS 195,393 A * 9/1877 Safianoff et al. ..... 222/267
211,504 A * 1/1879 Gray ..... 432/32
289,567 A * 12/1883 O'Connor et al. ..... 56/400.11
2,785,688 A * 3/1957 Chester ..... 132/210
3,181,540 A * 5/1965 Anton ..... 132/159
3,473,540 A 10/1969 Bulow
3,835,870 A 9/1974 Sick
4,993,438 A 2/1991 Hunt
5,626,153 A * 5/1997 Petrarca ..... 132/126
5,704,376 A * 1/1998 Ogunro ..... 132/213.1
5,947,130 A 9/1999 Musum

FOREIGN PATENT DOCUMENTS

BE 637955 1/1984
FR 1253367 2/1961

* cited by examiner

*Primary Examiner*—Todd E. Manahan
*Assistant Examiner*—Rachel A. Running
(74) *Attorney, Agent, or Firm*—Oblon, Spivak, McClelland, Maier & Neustadt, P.C.

(57) ABSTRACT

A comb for the hair includes a first side having a first series of teeth and a second side having a series of notches. At least one tooth is provided in the base of one or more of the notches. The tooth or teeth in the notch or notches have an end set back or recessed from the opening of the notch. The first and second sides extend on either side or in different directions from a lengthwise axis of the comb.

67 Claims, 3 Drawing Sheets

COMB CAPABLE OF BEING USED TO SEPARATE LOCKS OF HAIR

CROSS REFERENCE TO RELATED APPLICATIONS

This document claims priority to French Application Number 03 07921, filed Jun. 30, 2003 and U.S. Provisional Application No. 60/488,402, filed Jul. 21, 2003, the entire contents of which are hereby incorporated by reference.

FIELD OF THE INVENTION

The present invention relates to combs capable of being used to isolate locks of hair. The invention can be advantageously used in a hair treatment, for example, in applying a coloring or highlighting product.

BACKGROUND OF THE INVENTION

Discussion of Background

U.S. Pat. No. 4,993,438 describes a comb incorporating a first series of teeth on a first side. On a second side, opposite the first, a series of notches are provided, with teeth extending between the notches. Locks of hair can be engaged in the notches and thus separated from the rest of the hair, enabling the user to grasp them in order to apply the treatment.

However, there is a need to further facilitate the creation of colored or highlighted locks of hair, preferably by a single person. There is also a need to be able to color or highlight locks of hair in a reproducible manner over the entire head of hair.

SUMMARY OF THE INVENTION

According to one advantageous aspect, a comb for hair is provided which includes a first side incorporating a first series of teeth and a second side incorporating a series of notches. In addition, at least one tooth is provided in the base of at least one notch, with this tooth having an end set back or recessed from the opening of the notch. In illustrated examples, the first and second sides extend on either side of a lengthwise axis of the comb.

By virtue of the invention, locks of hair engaged in the notches can be smoothed out by the tooth or teeth located therein and, depending on the width of the notches, relatively wide and separated locks of hair can be formed.

In accordance with one of the advantageous aspects of the invention, the treatment, for example in the coloring of locks of hair, is facilitated, and the quality of the hairstyle or hair treatment is thus improved.

According to another advantageous aspect, a comb is provided that can be relatively inexpensive to make such that it can be marketed, for example, in a kit together with a hairstyling product.

The comb has a lengthwise axis, and the first and second sides are arranged relative to this lengthwise axis so that rotational movement applied to the comb about its lengthwise axis allows successive engagement of the teeth presented by each of these sides with at least one lock of hair.

In accordance with one example, the first series of teeth extends in a direction different from the direction in which the series of notches extends. The direction of a series of teeth is defined, for example, parallel to a lengthwise axis of at least one tooth in this series, from the base of the tooth towards its free end. The direction of a series of notches is defined, for example, parallel to a lengthwise axis of at least one notch in this series, from the base of the notch towards its opening.

In addition, the first series of teeth can also extend in a direction different from the direction in which the at least one tooth at the base of a notch extends. Preferably, the tooth or teeth at the base of the notches extend(s) in the same direction as the notches.

In a first embodiment, the first series of teeth, the series of notches and the teeth at the base of the notches extend in the same plane, so that the free ends of the teeth in the first series of teeth are opposite the notch openings and the free ends of the teeth defined at the base of these notches. With this arrangement, the teeth and the notches are oriented in a direction perpendicular to the lengthwise axis.

In a second embodiment, the first series of teeth extends over a first surface, not necessarily planar, with this first surface being set at an intersecting angle through the lengthwise axis of the comb to a second surface on which the series of notches extends, and possibly also the teeth defined at the base of these notches. For example, the angular difference between these two surfaces can be on the order of 90° or 120°. As a variant, an adjustable arrangement can also be provided by means enabling the respective positions of the first series of teeth to be modified relative to the series of notches.

Preferably, the free ends of the teeth in the first series of teeth are located on a line that is non-continuous with a line defined by the notch openings. The expression "non-continuous" means that the projection of a connection that may be made between these two lines in a plane including the lengthwise axis would intersect with the lengthwise axis. For example, where the first and second sides of the comb are substantially coplanar, a line extending from a line of the free end of one side (a line to which the free end generally extends) to a line of the free end of the other side will preferably pass through the lengthwise axis. In an example where the first and second sides extend at an angle with respect to each other, considering a projection of the lines of the free ends upon a plane that includes the lengthwise axis, a line extending from the projection of the line of one side to the projection of the line of the other side will preferably pass through the lengthwise axis.

Advantageously, at least one notch, or each notch, can include a series of teeth.

Preferably, the ends of at least some of the teeth in the first series, more preferably the ends of at least the majority of the teeth in the first series, are located substantially on an outwardly concave line, this line preferably having a curvature substantially matching that of the skull. This facilitates engagement of the comb in the hair, close to the roots.

In addition, the notches preferably emerge at an edge of the comb generally extending on an outwardly concave line, with this concave line also preferably having a curvature substantially matching that of the skull.

The number of notches can be between 2 and 20, for example. The number of teeth per notch can be between 1 and 10, for example.

Advantageously, the comb can include a body presenting the first and second sides, with a handle attached to one end of the body of the comb. In particular, the body can include a principal lengthwise axis parallel to the lengthwise axis of the comb, and the handle can be arranged so that it extends parallel to the principal lengthwise axis of the body.

In accordance with another aspect, a comb for hair is provided which includes a first side incorporating a first series of teeth, with the free ends of the teeth being located substantially on an outwardly concave line having a curvature substantially matching that of the skull. A second side incorporates notches and one or more teeth extending inside the notches, with this second side having an edge generally extending on an outwardly concave line having a curvature substantially matching that of the skull.

In accordance with yet another aspect, a process for treating hair, for example coloring or highlighting at least one lock of hair, is provided. The process includes using a comb as defined above. In accordance with this process, hair is combed using the first series of teeth. The comb is then turned about its lengthwise axis, with the hair held in the first series of teeth, so as to isolate locks of hair engaged on the tooth or teeth extending in the notches, with other locks of hair being drawn onto the comb away from the notches. A hair treatment is then performed or applied to at least one lock of hair thus isolated, for example, with a coloring or highlighting product.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
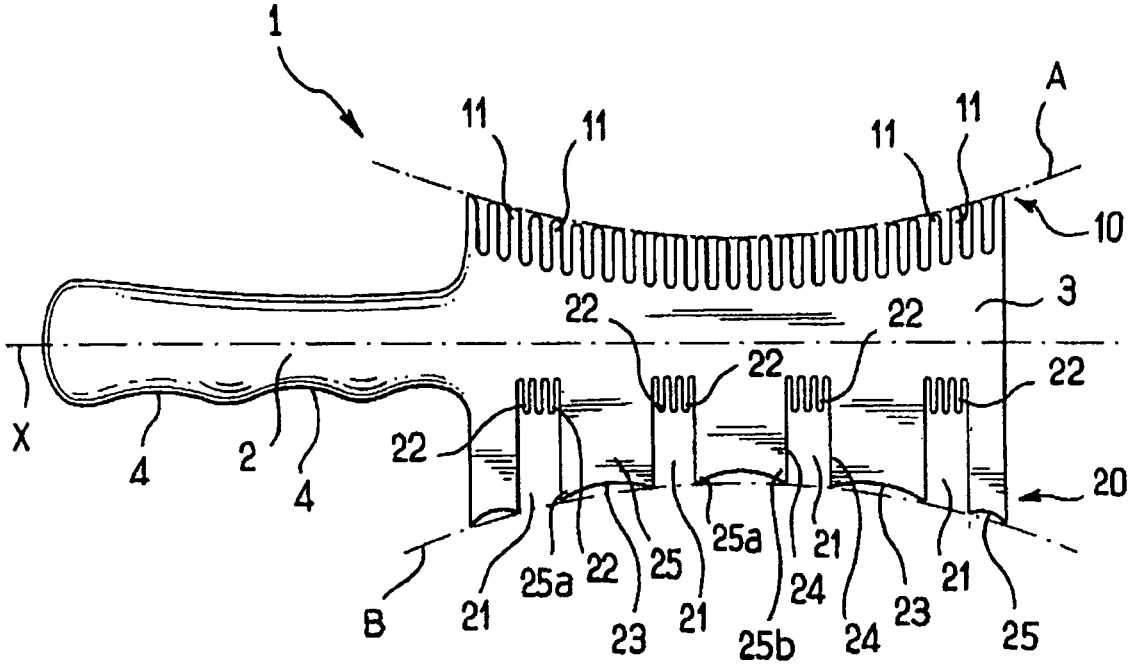
FIG. 1 is a side view illustrating an example of a comb made according to the invention.

The comb 1 illustrated in FIG. 1 has a generally flat and elongated shape on a lengthwise axis X. The illustrated arrangement includes a handle 2 and a body 3 fashioned, in the example shown, in a single piece by plastic molding. It is to be understood that the invention is not limited to a comb made of plastic, and metals can be used, for example. The handle 2 is advantageously provided with contoured projections 4 intended to improve its ergonomic design.

The body 3 includes, on a first side 10, a first series of teeth 11, and on a second side 20, diametrically opposite the first in this example, a series of notches 21. In addition, a second series of teeth 22 are provided in the base of each notch 21. As can be seen in FIG. 1, the free ends of the teeth 11 are located substantially along an outwardly concave line A, preferably having a curvature matching that of the skull.

In the illustrated example, at each notch 21, the comb 1 has a transverse cross-section smaller than the transverse cross-section of the comb between two notches 21. The portions 25 of the comb extending between the notches 21 have a relatively large width in the example illustrated.

The free ends of the portions 25 are located substantially along an outwardly concave line B, also preferably having a curvature matching that of the skull.

In the example illustrated, the free edge 23 of each portion 25 forms an outward-facing hollow having a curvature greater (or tighter, e.g., with a smaller radius) than that of the line B, thus defining projections 25*a* and 25*b* which tend to prevent hair bearing against the portions 25 from sliding into the notches 21.

The width of the notches 21 can be substantially constant from one notch to another. However, the invention can also be practiced with different notch widths or widths which vary along the lengthwise axis X. Similarly, the spacing between the teeth can be constant, however, in accordance with the invention, the spacing can also vary along the axis X.

As can also be seen in FIG. 1, in this example, each notch 21 has two rectilinear and substantially parallel edges 24, and that the height of the teeth 22 is considerably less than that of the corresponding notches 21, for example by a factor smaller than one-half.

The width of the notches 21 and the number of teeth 22 presented at the base of each notch 21 can be chosen in relation to the width of the locks of hair to be formed and also possibly in relation to the nature of the hair. Thus, for fine hair, the teeth can be more numerous and finer than for thick hair.

The comb 1 can be used in the following manner.

Figure 2:
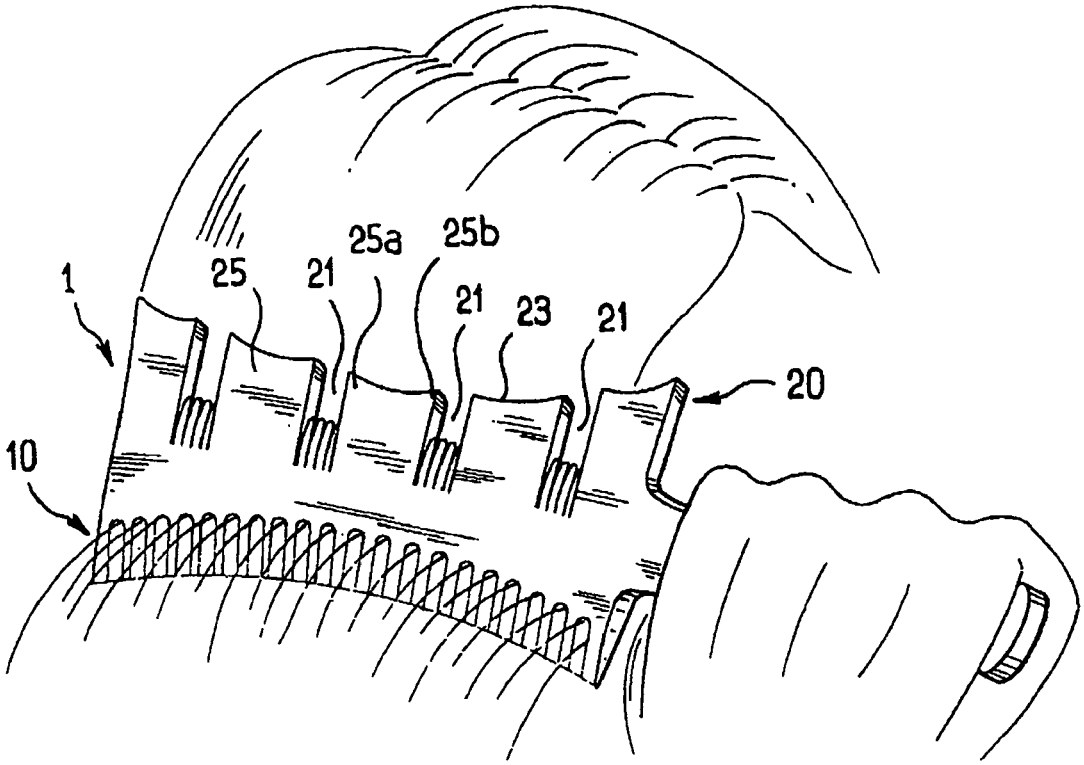
FIGS. 2 and 3 are perspective views illustrating the use of the comb in FIG. 1 to separate locks of hair.
Figure 3:
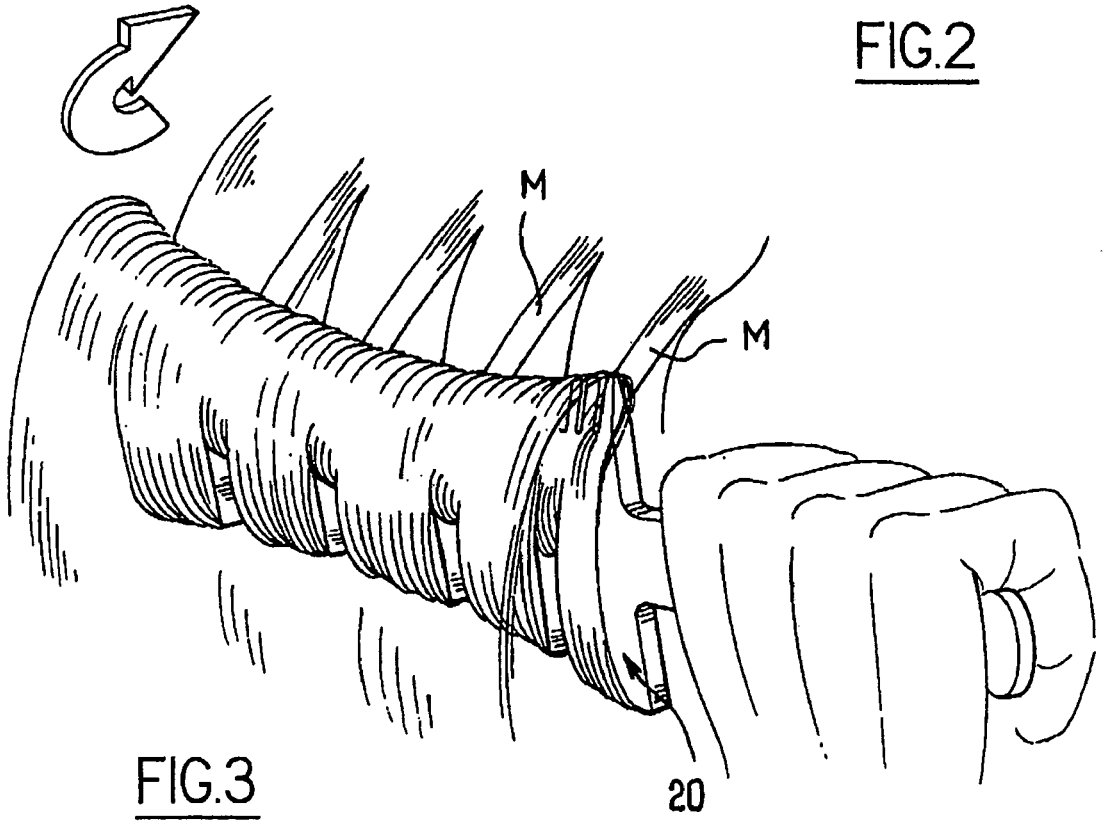

The user can start by combing the hair to achieve a smoothing effect using the first side 10 of the comb 1, as illustrated in FIG. 2. The user can then proceed to rotate the comb 1 about its lengthwise axis X, with the hair engaged between the teeth 11, so as to bring the edge 23 of the portions 25 into contact with the hair and to allow locks of hair to engage in the notches 21 and penetrate between the teeth 22, as illustrated in FIG. 3. The strands of hair wound onto the comb 1 inside the notches 21 are separated from the others. The absence of teeth on the edge 23 of the portions 25 facilitates the movement of the comb through the hair, notably when the hair is wound over. This operation serves to isolate locks of hair M, which the user can then grasp and treat by means of a hair treatment product, for example, for highlighting or coloring. Once a first lock of hair M has been isolated, the process can be repeated by altering the position of the comb so as to isolate other locks of hair.

The user can use the comb by locating a given notch 21, for example, that situated at the distal end of the comb, at a reference position on the head before commencing the treatment.

As required, the user can work with reference to a lock of hair already treated. This makes it possible, for example, to treat either the left or right side in the same manner as the other side.

Clearly, the invention is not limited to the example just described.

By way of example, the teeth can have shapes other than those illustrated, for example with the teeth including projections intended to grip the hair more securely.

Also, the second side 20 of the comb need not extend diametrically opposite the first side 10.

Figure 4:
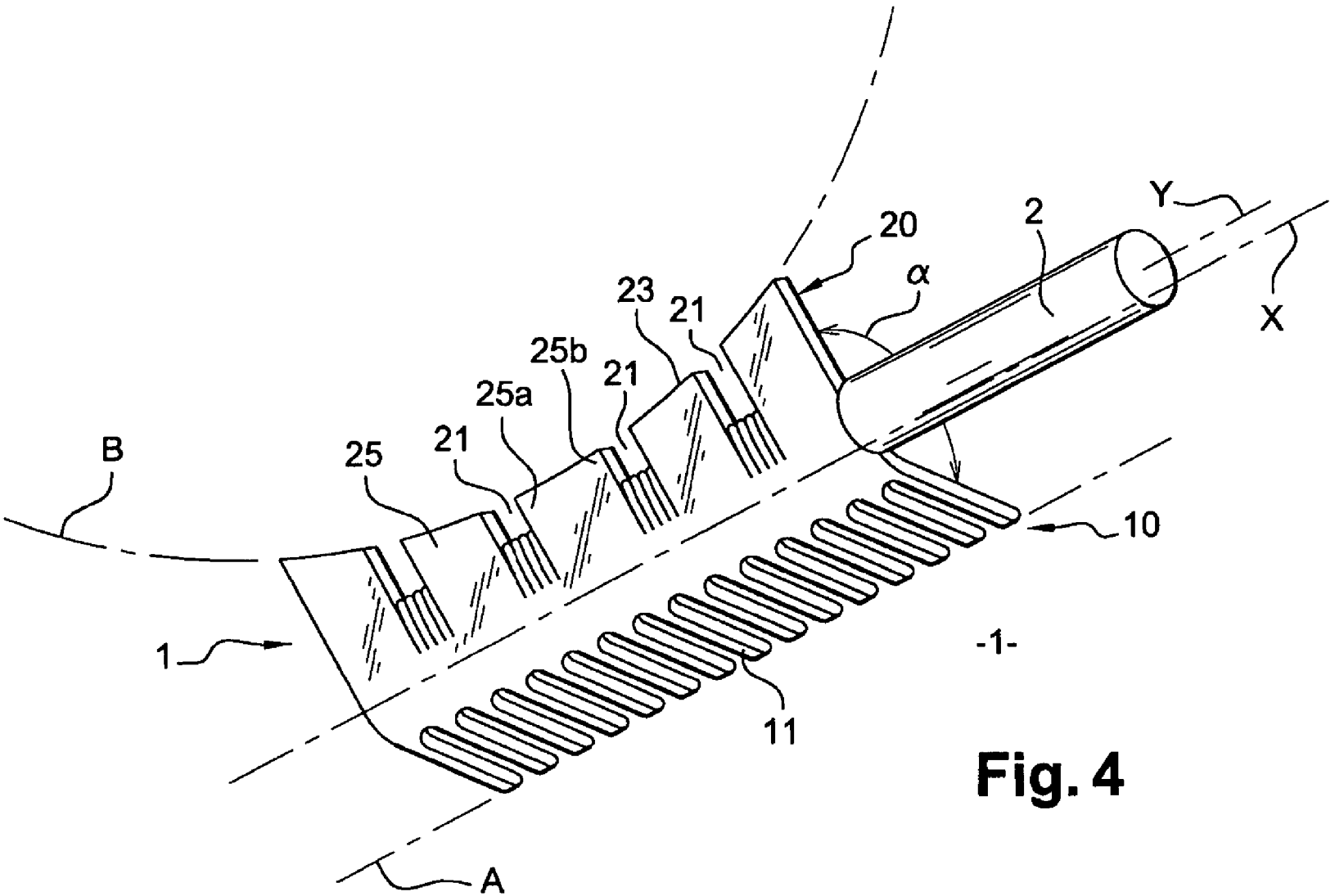
FIG. 4 is a perspective view of an alternative embodiment of a comb according to the invention.

As a variant, illustrated as a further example in FIG. 4, the comb is not flat but includes at least two portions extending in intersecting planes. As shown, the two portions are not coplanar and are not parallel. In particular, the first side 10 extends in a first plane intersecting with a second plane in which the second side 20 extends, with these two planes intersecting in particular at the lengthwise axis X. In particular, the angular difference $\alpha$ defined between these two planes is non-zero, for example of the order of 120°. The handle 2 has a principal lengthwise axis Y parallel to lengthwise axis X. The respective lengths of the first and second sides in the illustrated example, measured orthogonally to lengthwise axis X, can be different. Although the series of teeth on the first side 10 extend to a substantially straight line A in the illustrated example, as disclosed herein both sides can extend generally to concave lines of curvature, preferably lines having a curvature substantially matching that of a skull.

Throughout the description, including the claims, expressions such as "including a" or "comprising a" should be understood to be synonymous with "including at least one" unless otherwise specified.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A comb for hair including:

a first side including a first series of teeth;

a second side including a series of notches and a plurality of portions, wherein each notch of the series of notches is disposed between respective adjacent portions of said plurality of portions;

at least one tooth in a base of at least one notch of the series of notches, wherein the at least one tooth has an end recessed from an opening of the notch, wherein a width of the at least one tooth is less than a width of each of the adjacent portions of the at least one notch along an entire length of each of the adjacent portions, and wherein the first and second sides extend on either side of a lengthwise axis of the comb.

2. A comb according to claim 1, wherein at least two notches of the series of notches each include a plurality of teeth.

3. A comb according to claim 2, wherein each notch includes a plurality of teeth each having a width smaller than a width of each respective adjacent portion of each notch.

4. A comb according to claim 3, wherein ends of at least some of the teeth in the first series are located substantially on a first concave line.

5. A comb according to claim 1, wherein ends of at least some of the teeth in the first series are located substantially on a first concave line.

6. A comb according to claim 5, wherein ends of at least a majority of the teeth of the first series are located substantially on said first concave line.

7. A comb according to claim 6, wherein said first concave line has a curvature substantially matching that of a skull.

8. A comb according to claim 5, wherein said first concave line has a curvature substantially matching that of a skull.

9. A comb according to claim 8, wherein the notches extend to an edge of the comb generally extending on a second concave line.

10. A comb according to claim 9, wherein the second concave line has a curvature substantially matching that of a skull.

11. A comb according to claim 1, wherein the notches extend to an edge of the comb generally extending on a concave line.

12. A comb according to claim 11, wherein the concave line has a curvature substantially matching that of a skull.

13. A comb according to claim 1, wherein the series of notches includes from 2 to 20 notches.

14. A comb according to claim 13, wherein each notch of the series of notches includes from 1 to 10 teeth in the base of each notch.

15. A comb according to claim 1, wherein the at least one notch includes from 3 to 10 teeth in the base.

16. A comb according to claim 1, wherein the comb is a one-piece molded plastic article.

17. A comb according to claim 1, wherein the comb includes a body having said first and second sides, and wherein a handle is attached to one end of the body.

18. A comb according to claim 17, wherein the body has a principal lengthwise axis parallel to a lengthwise axis of the handle.

19. A comb as recited in claim 1, further including a handle for grasping the comb at a location spaced from the first and second sides in a lengthwise direction of the comb.

20. A comb as recited in claim 1, wherein said first and second sides extend in diametrically opposite directions.

21. A comb according to claim 1, wherein at least some of said plurality of portions include concave edges.

22. A comb according to claim 21, wherein said second side extends to a concave line of curvature, and wherein the concave edges of the at least some of said plurality of portions have a curvature greater than that of said concave line of curvature.

23. A comb according to claim 1, wherein teeth are absent from the adjacent portions.

24. A comb according to claim 23, wherein teeth are absent from each of the plurality of portions.

25. A comb as recited in claim 1, wherein the series of notches include plural notches each having at least one tooth in a base thereof and each having a width smaller than their respective adjacent portions.

26. A comb as recited in claim 25, wherein teeth are absent from each of the adjacent portions, and wherein the first and second sides have free ends respectively extending to first and second concave lines.

27. A comb as recited in claim 26, wherein the respective adjacent portions of each of the plural notches have concave edges with a curvature different from that of said second concave line.

28. A comb as recited in claim 26, wherein teeth of said first series of teeth have a width smaller than widths of said plurality of portions.

29. A comb as recited in claim 1, wherein the series of notches include plural notches each having at least one tooth therein with a width smaller than the respective adjacent portions of the plural notches.

30. A comb as recited in claim 29, wherein teeth of the first series of teeth have a width smaller than widths of said plurality of portions.

31. A comb as recited in claim 30, wherein teeth are absent from each of the adjacent portions, and wherein the first and second sides have free ends respectively extending to first and second concave lines.

32. A comb for hair including:

a first side including a first series of teeth;

a second side including a series of notches and a plurality of portions, wherein each notch of the series of notches is disposed between respective adjacent portions of said plurality of portions;

at least one tooth in a base of at least one notch of the series of notches, wherein the at least one tooth has an end recessed from an opening of the notch, wherein a width of the at least one tooth is less than a width of each of the adjacent portions of the at least one notch along an entire length of each of the adjacent portions, wherein the first and second sides extend on either side of a lengthwise axis of the comb, and wherein said first and second sides are not coplanar and extend at a non-zero angle with respect to each other.

33. A comb for hair including:

a first side including a first series of teeth, wherein free ends of the first series of teeth are located substantially on a first concave line having a curvature substantially matching that of a skull;

a second side including a series of notches and a plurality of portions, wherein the second side has an edge generally extending on a second concave line having a curvature substantially matching that of a skull, wherein one notch of the series of notches is disposed between adjacent portions, wherein a width of the notch is less than a width of at least one of the adjacent portions, and wherein the notch includes at least two teeth disposed therein, and wherein the series of notches include plural notches each disposed between respective adjacent portions and each having a width smaller than each of the respective adjacent portions, wherein teeth of said first series of teeth have widths smaller than widths of the plurality of portions.

34. A comb according to claim 33, wherein a plurality of notches of said series of notches include at least one tooth therein.

35. A comb according to claim 34, wherein the plurality of notches each include a plurality of teeth therein.

36. A comb according to claim 33, wherein the series of notches includes from 2 to 20 notches and wherein each notch includes from 1 to 10 teeth therein.

37. A comb according to claim 33, wherein the comb includes a body having said first and second sides, and wherein a handle is attached to one end of the body.

38. A comb according to claim 37, wherein the body has a principal lengthwise axis parallel to a lengthwise axis of the handle.

39. A comb as recited in claim 33, further including a handle for grasping the comb at a location spaced from the first and second sides in a lengthwise direction of the comb.

40. A comb as recited in claim 33, wherein said first and second sides extend in diametrically opposite directions.

41. A comb as recited in claim 33, wherein said first and second sides are not coplanar and extend at a non-zero angle with respect to each other.

42. A comb according to claim 33, wherein the notch has a height extending from a base to an opening of the notch which is larger than a height of at least one tooth of the at least two teeth such that the tooth is recessed from the opening of the notch.

43. A comb according to claim 33, wherein at least some of said plurality of portions include concave edges.

44. A comb according to claim 43, wherein the concave edges of the at least some of said plurality of portions have a curvature greater than that of said second concave line.

45. A comb according to claim 33, wherein teeth are absent from the adjacent portions.

46. A comb according to claim 45, wherein teeth are absent from each of the plurality of portions.

47. A comb for hair comprising:

a body having a lengthwise axis, said body including a first side on one side of said lengthwise axis and a second side on another side of said lengthwise axis such that said lengthwise axis is between said first side and said second side;

wherein said first side includes a first series of teeth;

wherein said second side includes a series of notches and a plurality of protruding portions disposed such that one notch is located between adjacent protruding portions wherein the series of notches include plural notches each disposed between respective adjacent protruding portions and each having a width smaller than each of the respective adjacent protruding portions, wherein teeth of said first series of teeth have widths smaller than widths of the plurality of protruding portions; and wherein at least one of said first side and said second side extends to a concave line of curvature.

48. A comb as recited in claim 47, wherein each of said first side and said second side extends to a concave line of curvature.

49. A comb as recited in claim 48, wherein a plurality of said series of notches each include at least one tooth.

50. A comb as recited in claim 48, wherein a plurality of the series of notches each include at least one tooth extending from a base of each of the plurality of notches.

51. A comb as recited in claim 50, wherein each of the plurality of notches includes a plurality of teeth extending from the base of each of the plurality of notches, and wherein teeth are absent from the plurality of protruding portions, and wherein the first and second sides extend to respective first and second concave lines.

52. A comb as recited in claim 51, further including a handle for grasping the comb at a location spaced from the first and second sides in a lengthwise direction of the comb.

53. A comb as recited in claim 52, wherein said first and second sides extend in diametrically opposite directions.

54. A comb as recited in claim 47, further including a handle for grasping the comb at a location spaced from the first and second sides in a lengthwise direction of the comb.

55. A comb as recited in claim 47, wherein said first and second sides extend in diametrically opposite directions.

56. A comb as recited in claim 47, wherein said first and second sides are not coplanar and extend at a non-zero angle with respect to each other.

57. A comb as recited in claim 47, wherein a plurality of the series of notches each include at least one tooth extending from a base of each of the plurality of notches.

58. A comb as recited in claim 57, wherein each of the plurality of notches includes a plurality of teeth extending from the base of each of the plurality of notches.

59. A comb according to claim 58, wherein free ends of said teeth disposed in said plurality of notches are recessed inside of said plurality of notches.

60. A comb as recited in claim 47, wherein the series of notches includes from 2 to 20 notches, and wherein each notch includes from 1 to 10 teeth extending from a base of each notch.

61. A comb according to claim 47, further including a handle having a lengthwise axis which is parallel to the lengthwise axis of said body.

62. A comb according to claim 61, wherein the lengthwise axis of the body is spaced from the lengthwise axis of the handle.

63. A comb according to claim 47, wherein the second side extends to a concave line of curvature, wherein each notch of said series of notches is defined between adjacent protruding portions, and wherein at least some of said protruding portions include a free edge which is partially recessed from the concave line of curvature of the second side.

64. A comb according to claim 63, wherein the free edge of the at least some of said protruding portions includes a concave profile having a curvature greater than that of said concave line of curvature.

65. A comb according to claim 64, wherein free ends of said first series of teeth extend to a concave line of curvature.

66. A comb according to claim 47, wherein teeth are absent from the adjacent protruding portions.

67. A comb according to claim 66, wherein teeth are absent from each of the plurality of protruding portions.

* * * * *